United States Patent [19]

Shwayder et al.

[11] 4,064,716

[45] Dec. 27, 1977

[54] SAW RESISTANT LOCK

[75] Inventors: Warren M. Shwayder, Bloomfield Hills; John T. Loftus, Detroit, both of Mich.

[73] Assignee: The Shwayder Company, Birmingham, Mich.

[21] Appl. No.: 673,426

[22] Filed: Apr. 5, 1976

[51] Int. Cl.[2] ..... E05B 67/22

[52] U.S. Cl. ..... 70/38 A; 70/39; 70/52; 70/53; 70/417

[58] Field of Search ..... 70/38 A, 39, 417, 52, 70/38 R, 38 B, 38 C, 53, 32–34

[56] References Cited

U.S. PATENT DOCUMENTS

| | | | |
|---|---|---|---|
| 1,384,590 | 7/1921 | Bottone | 70/39 X |
| 3,777,517 | 12/1973 | Shwayder | 70/53 |
| 3,855,826 | 12/1974 | Hori | 70/38 A |

FOREIGN PATENT DOCUMENTS

| | | | |
|---|---|---|---|
| 686,327 | 3/1965 | Italy | 70/39 |

*Primary Examiner*—Robert L. Wolfe

*Attorney, Agent, or Firm*—Cullen, Settle, Sloman & Cantor

[57] ABSTRACT

A lock formed of a bar and a shackle whose legs extend into transverse holes formed in the bar. A rotatable bolt extends within and is completely concealed within the bar and overlaps the leg portions located within the bar. Aligned notches in the legs and bolt permit the bolt to be rotated into a position wherein peripheral portions thereof extend within the leg notches for locking the legs within the bar, and to a second position wherein the bolt notches align with the legs for transverse movement of the legs relative to the bar for unlocking. Locking means arranged within the bar permit selective manual rotation of the bolt. The shackle and bar may be formed of a saw resistant material to form a closed, saw resistant loop.

10 Claims, 22 Drawing Figures

FIG. 1
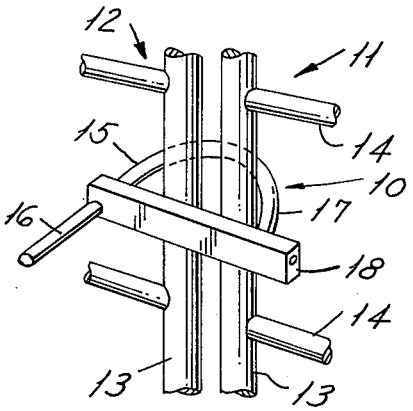
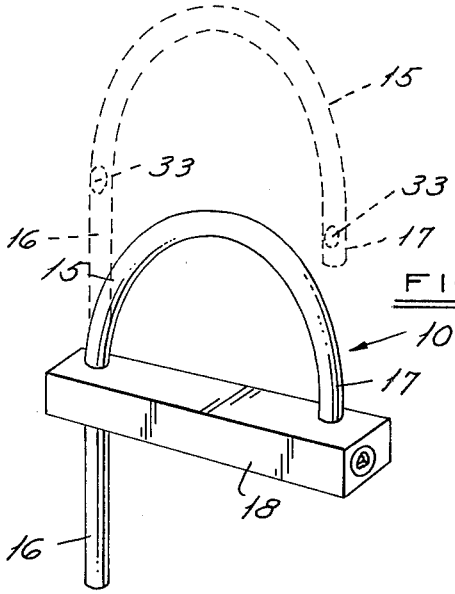
FIG. 2
FIG. 3
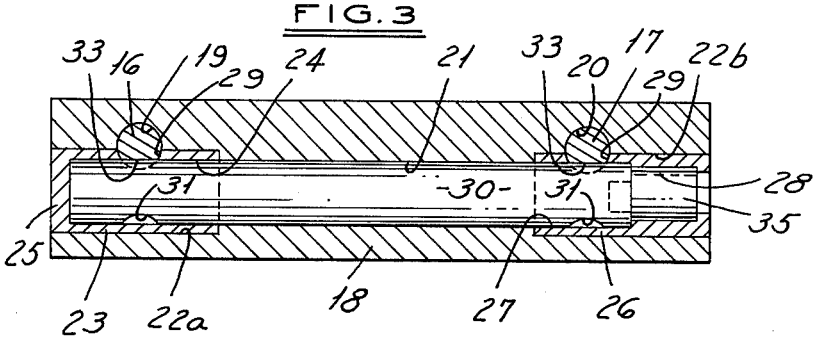
FIG. 5
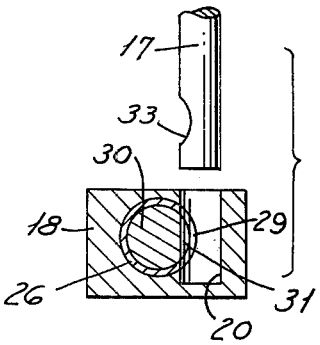
FIG. 4
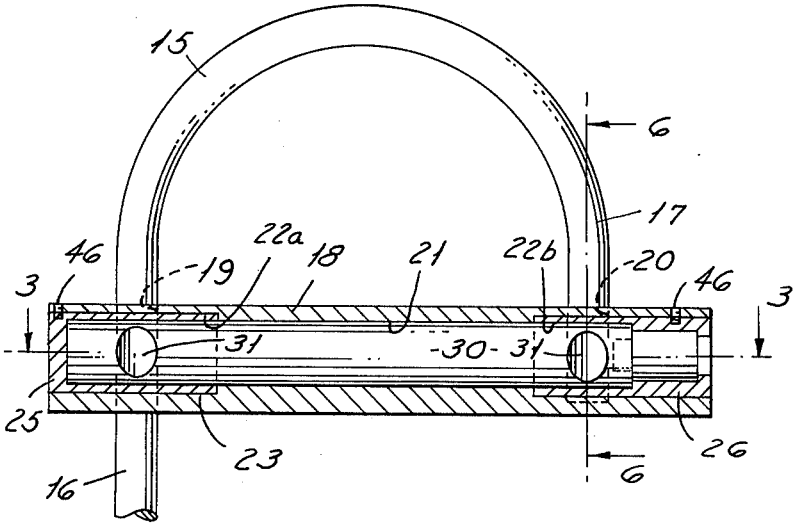
FIG. 6
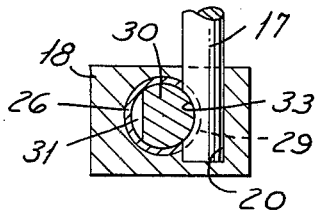

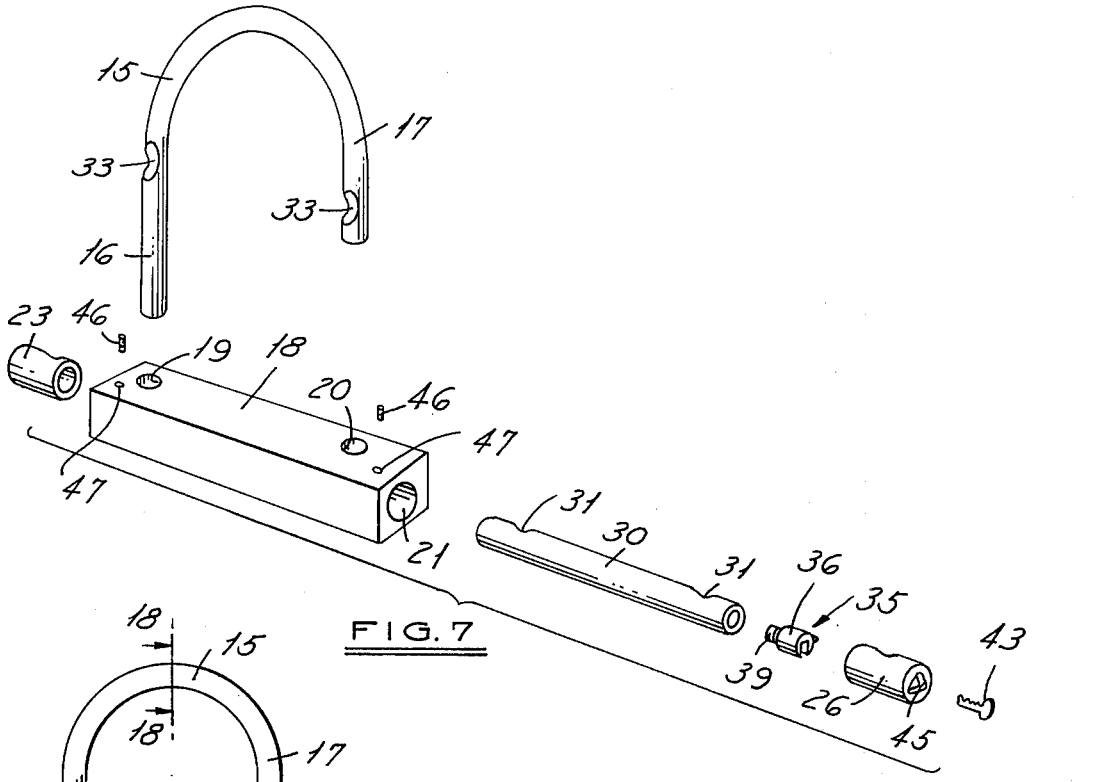
FIG. 7
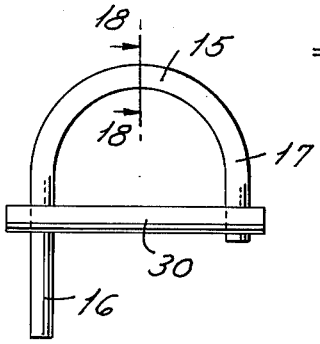
FIG. 8
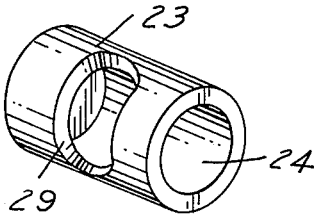
FIG. 9
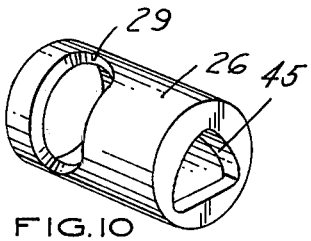
FIG. 10
FIG. 12
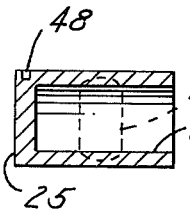
FIG. 11
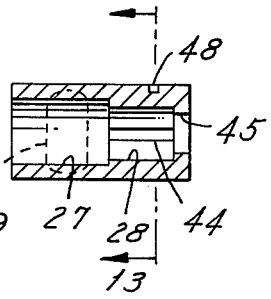
FIG 13
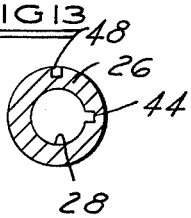
FIG. 16
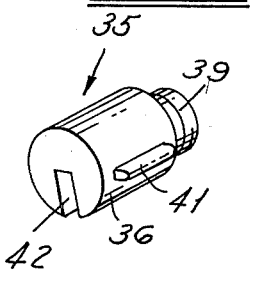
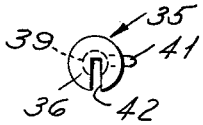
FIG. 14
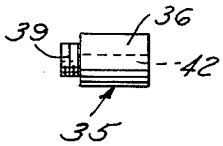
FIG. 15
FIG. 17
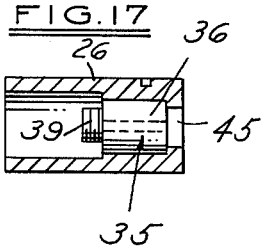

SAW RESISTANT LOCK

BACKGROUND OF THE INVENTION

In enclosure type fences, as for example, fences formed of metal posts and steel mesh for enclosing a storage yard or truck or vehicle parking area or the like, it is conventional to provide a swinging gate which is usually locked closed with a chain and conventional lock. The combination of a metal chain and lock is additionally used to lock various types of gates as well as to lock articles, such as bicycles or the like, to fixed posts, etc. However, conventional chains and locks are relatively easy to break or cut using a saw or a heavy duty clipping device or the like. Thus, efforts have been made to provide chains and locks which are more saw resistant and more difficult to otherwise cut or break, but only with limited success. Hence, there has long been a need for a locking device to perform the function of a chain and conventional lock for locking gates, articles such as bicycles, etc., and which locking device is resistant to sawing or cutting or breaking by other tools.

Thus, the invention herein relates to a lock which may perform the function of a conventional chain and lock combination, that is, with a shackle which can encircle relatively large items, such as a portion of a fence or gate, etc., and a locking mechanism so formed as to resist normal cutting or breakage. Alternatively, locking pins or legs may be used instead of a unitary shackle. Such a lock thus completely eliminates the need for conventional chains and provides far better security than is currently available with conventional chain and lock combinations.

SUMMARY OF INVENTION

The invention herein contemplates a lock of a size and shape which can replace a conventional chain and lock combination, and which is formed of a large U-shaped shackle portion whose legs extend into holes formed in a base. A locking bolt concealed therein extends in overlapping relationship across the portions of the shackle legs contained within the base. The bolt is rotatable into a shackle engaging and locking position and into a second release position.

The bolt is supported within bushings, at its opposite ends, which bushings are completely concealed within the elongated base and with at least one of the bushings containing a simple, conventional key operated lock mechanism which is concealed and protected against tampering. Thus, the entire lock essentially comprises only six relatively simple and inexpensive parts, namely, an elongated bar-like base, the bent shackle, the bolt and a pair of bushings, and the conventional lock mechanism, all assembled together in such a manner as to conceal and to protect within the base all of the parts and the engagement points of the parts.

Alternatively, a pair of separate legs or pins, each fastened to one of the two members to be locked (i.e., a gate edge and post or adjacent edges of a pair of doors, etc.) may be utilized instead of a unitary shackle.

The shackle (or pins) and the bolt may be made of a saw resistant material such as that disclosed in the patent to Shwayder et al, U.S. Pat. No. 3,777,517, issued Dec. 11, 1973, and in Shwayder, U.S. Ser. No. 492,191, filed July 26, 1974, which is generally formed of a tube having a metal core fitted therein and with longitudinal spaces between the core and the interior of the tube wall, which spaces are filled with a matrix of hard particulate material such as tungsten carbide particles and a relatively soft binder, such as brazing compounds or the like. Thus, a closed loop of saw resistant material is formed. Such loop comprises the bent shackle portion which may encircle articles to be locked, or the pins, and the bolt which is concealed within the bar-like base. When formed of such material, the loop is virtually impossible to cut through or break through with normal available saws and cutting devices so that for all practical purposes it becomes tamper proof and break proof.

Because of its simplicity of design, the lock herein is relatively inexpensive and also is simple to operate and is resistant to jamming. Also, it permits the use of a simple and inexpensively constructed key operated lock mechanism of low strength, since the mechanism is completely concealed within and protected by the surrounding lock base in a way that it cannot be easily damaged.

These and other objects and advantages of this invention will become apparent upon reading the following description, of which the attached drawings form a part.

DESCRIPTION OF DRAWINGS

FIG. 1 illustrates the lock herein utilized to lock together a pair of adjacent swinging fence gates.

FIG. 2 is an enlarged perspective view showing the lock in its closed position and showing, in dotted lines, the open position.

FIG. 3 is a cross-sectional plan view taken in the direction of arrows 3—3 of FIG. 4, and FIG. 4 is a partially cross-sectioned elevational view of the lock showing the shackle in lock position.

FIG. 5 and FIG. 6 are cross-sectional end views taken in the direction of arrows 6—6 showing the bolt in the unlocking position and in the locking position, respectively.

FIG. 7 is a perspective, exploded view, showing the parts disassembled.

FIG. 8 illustrates the saw resistant closed loop formed of the shackle and the crossing bolt.

FIG. 9 and FIG. 10 illustrate enlarged perspective views of the blind end bushing and the open end, lock mechanism receiving, bushing, respectively.

FIGS. 11 and 12 are cross-sectional views of the two bushings.

FIG. 13 is a cross-sectional end view of the open end bushing taken in the direction of arrows 13—13 of FIG. 12.

FIG. 14 is an end view of the locking mechanism, and

FIG. 15 is an elevational view of the locking mechanism.

FIG. 16 is a perspective view of the locking mechanism.

FIG. 17 is a view of the locking mechanism arranged within the bushing (shown in cross-section).

DETAILED DESCRIPTION

Figure 18:
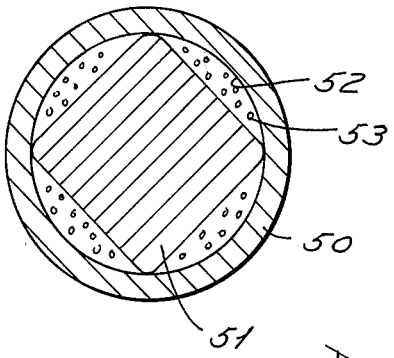
FIG. 18 is an enlarged, cross-sectional view taken in the direction of arrows 18—18 of FIG. 8, showing the saw resistant material in cross-section.

FIG. 1 illustrates the saw resistant lock 10 functioning as a gate lock to replace a conventional chain and lock combination for locking together a pair of adjacent swinging gates 11 and 12 by encircling the adjacent vertical gate parts 13. The gate is shown schematically as having vertical parts and horizontal stringers 14. Of course, the lock herein can be used to lock a variety of devices, and thus, FIG. 1 is illustrative of one form of use of this device, wherein the U-shaped shackle 15 is of sufficient size to substitute for and eliminate the need for a conventional chain.

The lock comprises a U-shaped shackle 15 having a long leg 16 and a short leg portion 17 and a bar-like base 18 having a transverse hole 19 through which the long leg is inserted as shown in FIG. 4. A second, blind hole 20 receives the short leg. The blind hole conceals the free end of the short leg. However, for some purposes, the blind hole may be drilled completely through the base similarly to the through hole 19.

A bore 21 extends longitudinally through the base and its opposite ends are counterbored to provide enlarged bore opposite end portions **22*a* and 22*b*** (see FIG. 3). The intersections of the bore and enlargements with the central portion of the bore form internal annular shoulders or stops.

A cylindrically shaped bushing 23 is arranged within the enlarged bore end **22*a* with its inner end abutted against the annular shoulder. The bushing is provideed with a bore 24 which extends partway through it so as to provide a blind or closed base 25 which preferably is coplanar with the corresponding end of the base 18**.

An open ended bushing 26 is inserted within the opposite bore end **22*b*. This bushing is provided with an inner bore 27 portion, a reduced diameter central bore portion 28**. Like the other bushing, this too is arranged with its inner end abutted against the adjacent annular shoulder.

Each of the bushings is provided with a notch 29 (see FIGS. 9 and 10) which notches are of a size to receive and encircle a portion of the legs of the shackle. The bushings preferably are formed of a hardened material, i.e., hardened steel.

Arranged witin the base bore is an elongated cylindrically shaped rotatable bolt 30 whose opposite ends are inserted within and rotatably mounted within the respective bushings. Thus, the bolt is completely concealed within the base and is protected by the base and the opposite bushings.

The bolt is formed with a pair of notches or grooves 31 which, upon rotation of the bolt, are in alignment with the notches 29 of the bushings. Corresponding notches or grooves 33 are formed in each of the shackle legs. Thus, when the shackle legs are inserted through the respective holes 19 and 20, by aligning the bolt notches with the bushing notches, the leg portions of the shackle are free to slide transversely of the base. This is illustrated in FIG. 5 which shows the bolt rotated so that its notches are in alignment with the bushing notches. However, upon rotation of the bolt, peripheral portions of the bolt overlap and extend into the notches or grooves 33 in the shackle legs to thereby lock the shackle against withdrawal or movement relative to the base. This is illustrated in FIG. 6.

A conventional, inexpensive and simplified lock mechanism 35 is provided for selectively and manually rotating the bolt. Essentially, such lock mechanisms are formed of a cylindrical body 36 which is fitted into the reduced diameter bore portion 28 of the bushing 26 (see FIG. 15). A stud portion 39, preferably threaded, is threadedly engaged within a threaded end hole 40 formed in the bolt. Thus, the entire lock, that is, the cylinder 36 with the stud 39, can be rotated to thereby rotate the bolt which is fastened thereto.

The lock itself is provided with a retractable catch 41 which catch is withdrawn or retracted by means of a conventional key 43 fitted into a key slot 42 which slot is aligned with the opening 43 formed in the outer end of bushing 26. When extended, the catch engages a groove 44 formed in the bore portion 28 (see FIGS. 12 and 13).

The particular lock mechanism utilized forms no part of this invention, but rather any simple, inexpensive and conventional mechanism can be used, provided it is generally of the shape to fit within the surrounding parts as indicated and to function to rotate the bolt. The bushing opening 45 is shaped to receive and permit rotation of the lock key, while the end of the bushing protects the lock against tampering.

The bushings 23 and 26 are non-rotatably mounted within the base. Thus, to keep them properly positioned, they may be press fitted within the base bore, or preferably, are closely fitted therein and then prevented from rotating by pins 46 extending through pin holes 47 formed in the base and corresponding pin receiving holes 48 formed in the bushings. Thus, to disassemble the lock, the pins may be either drilled out or otherwise removed to thereby release the bushings, etc.

For some purposes the blind end bushing 23 may be replaced by another open end bushing 26 with a locking mechanism like that described above, so that the bolt is locked from both ends.

It is desired that the shackle and the bolt be made of a material which is saw resistant and impact resistant as well as resistant to cutting by large, readily available, cutting mechanisms or tools. Thus, the shackle and bolt may be formed of a case hardened steel or suitable stainless steel. However, for maximum effect, it is desirable to form these parts out of saw resistant material such as described in the above-mentioned patent and application of Shwayder et al.

Such material is essentially formed of a thin wall metal tube or sleeve 50, e.g., formed of stainless steel, containing a polygonal shaped metal core 51, as for example an approximately square shaped steel rod or hexogonal steel rod, etc., wherein longitudinal spaces 52 are formed between the core and the interior wall of the sleeve or tube. Such spaces are filled with a matrix 53 made of hardened particles, such as tungsten carbide or similar hard carbide particles with a soft binder such as a suitable brazing material to form a hard mass with the binder substantially filling the spaces between the particles and holding them against movement. Such type of construction, with the abovementioned matrix, tends to break the teeth of conventional saws used for cutting metal and are extremely difficult to break or cut through with mechanical cutting tools. Thus, for all practical purposes, they are breakproof and cutproof. That is, they provide in the lock herein, sufficient resistance to protect against all but determined professional efforts utilizing more than normally available tools.

In operation, the user of the lock may grasp the free end of the shackle long leg 16 and push the shackle U-shaped portion away from the base so that the shackle may encircle the objects to be locked together, in the same way as a chain would otherwise be used. Thereafter, the short leg 17 is inserted into the corresponding base hole 20 and the locking mechanism 35 is rotated, as by inserting a key therein, for rotating the bolt so that the bolt peripheral portions enter into the notches 33 formed on the shackle legs. For opening the lock, the bolt is rotated to align its notches with the legs of the shackle so that the shackle may be withdrawn from the base.

The bolt is completely concealed within the base and it as well as the bushings are firmly locked by the shackle legs as well as vice-versa to prevent knocking the bolt or the bushings out endwise with a hammering tool. Further, the locking mechanism 35 is almost completely concealed within the surrounding bushing and base, with the exception of its keyhole exposed face portion, so that it too is tamperproof. Thus, the only exposed portions of the lock are the shackle and the base and any attempt to cut through the shackle is frustrated by the shackle material itself. Likewise, an attempt to cut through the base is frustrated by the bolt which completes the sawproof loop comprising the shackle plus bolt.

Figure 19:
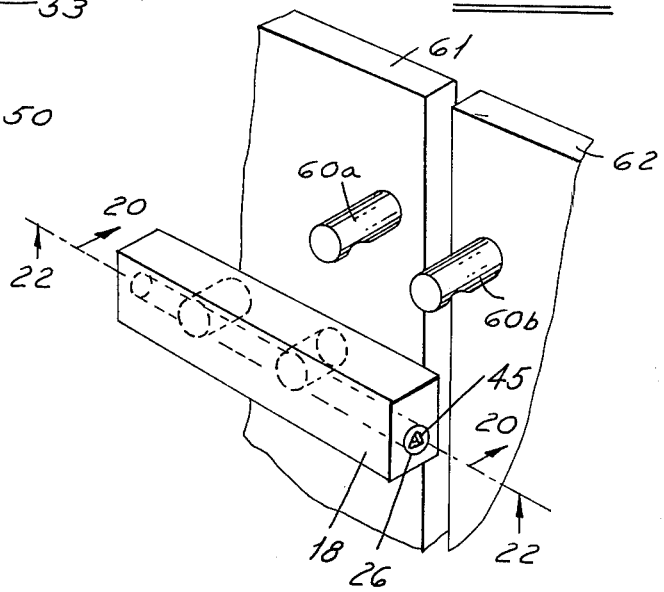
FIG. 19 is a perspective view of a modification using separate pins or legs rather than a unitary shackle.
Figure 22:
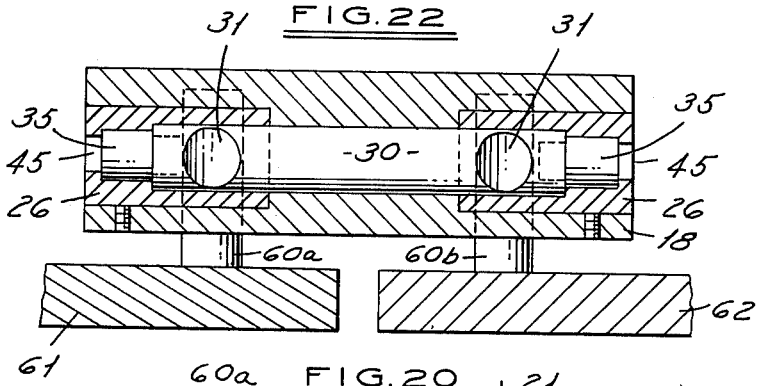
FIG. 22 is a cross-sectional view taken on lines 22—22 of FIG. 19.
Figure 21:
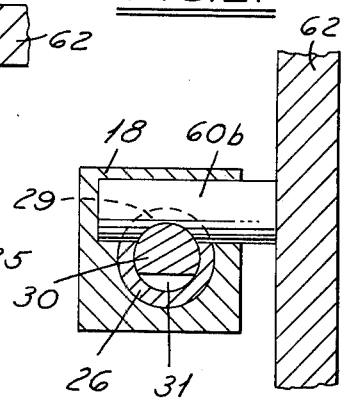
FIG. 21 is a cross-sectional view taken on lines 21—21 of FIG. 20.
Figure 20:
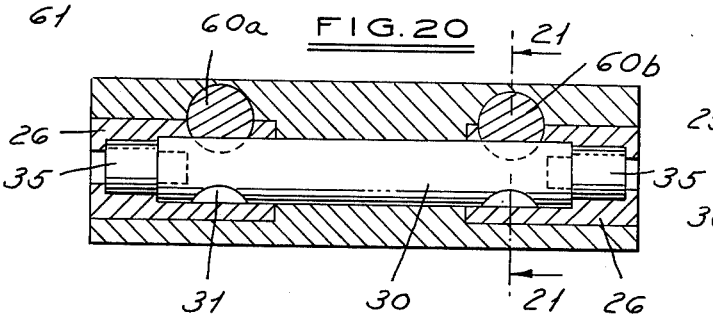
FIG. 20 is a plan view of the modification of FIG. 19.

FIGS. 19–20 illustrate a modification wherein separate legs or pins 60*a* and 60*b* replace the unitary U-shaped shackle described above. The legs or pins are fastened, e.g., as by welding, to adjacent edges of members to be locked together, as for example, to the adjacent edges of a pair of metal doors 61–62.

The lock construction is otherwise the same as that described above, except open end bushings 26 and lock mechanisms 35 are used at both ends of the base 18.

The pins 60*a* –*b* may each be of the same length, in which case the holes for receiving them in the base may both be blind hole constructions the same as hole 20 described above. Alternatively, one leg may be longer than the other, so as to provide a place to hang the base from when the other leg is not inserted in the bar. In that case, the open base hole 19, described above, may be used.

Having fully described an operative embodiment of this invention, we now claim:

1. A lock comprising:

a bar-like base having a pair of spaced apart holes formed transversely thereof, and a bore extending longitudinally through said base;

a U-shaped shackle having its legs normally extending into said base holes for locking therein;

an elongated bolt member rotatably fitted within said bore and spanning the space between and overlapping said shackle legs within the bar;

each of said legs having a notch formed therein for partially receiving the adjacent overlapping portions of said bolt member and a notch formed in said bolt in alignment with each shackle leg, whereby axial rotation of said bolt member causes peripheral portions of said bolt member to enter into the shackle notches and thereby lock the shackle within the base, and continued rotation causes the bolt notches to axially align with the shackle legs for endwise movement of the legs relative to the base for unlocking the shackle;

and locking means operable for rotating said bolt;

the opposite ends of said base bore each being of an enlarged diameter relative to the central portion thereof;

a centrally bored bushing inserted and closely fitted within each of said bore opposite ends and receiving the adjacent end portion of said bolt for rotation of said bolt within the bushings, and each bushing having a notch aligned with and receiving its adjacent shackle leg portion, and also aligned with a bolt notch arranged within the respective bushing;

and said lock means being mounted within one of said bushings for rotation of said bolt.

2. A lock as defined in claim 1, and said bushings each being completely contained within said base, with each bushing having its inner end, i.e., relative to its adjacent base end, retained from moving inwardly, that is, towards the opposite bushing, by an annular shoulder formed at the intersection of the central portion of the base bore and its enlarged end portion.

3. A lock as defined in claim 2 and with the bushing within which the lock means is mounted being formed with a closed base having a bore of smaller diameter than the bushing bore, and with said lock means being in the form of a cylinder fitted within said smaller diameter bushing bore and having an end portion secured to its adjacent bolt end, wherein the lock means is concealed and protected within the bushing and is exposed only at an opening formed in the base end for operating access to said lock means.

4. A lock as defined in claim 2, and said other bushing having a closed end arranged at the adjacent end face of the base, wherein said bushings, bolt and lock means are all concealed and protected within the base.

5. A lock as defined in claim 1, and said shackle being formed with one its legs considerably longer than the other, and wherein the shackle receiving holes into which said long leg is inserted extends completely through the bar so that the long leg extends outwardly of the bar opposite to the direction of the U-shaped portion of the shackle.

6. A lock as defined in claim 5, and wherein the shackle short leg receiving hole is formed as a blind hole, that is, extending only partially through said base so that the free end of the short leg is concealed within the base when locked therein.

7. A lock comprising:

an elongated bar-like base having a pair of spaced apart holes formed transversely thereof, and a bore extending longitudinally through said base;

a pair of spaced apart pin-like legs normally extending axially into said base hole for locking therein;

an elongated bolt member rotatably fitted within said bore and spanning the space between and overlapping said legs within the bar;

each of said legs having a notch formed therein for partially receiving the adjacent overlapping portions of said bolt member and a notch formed in said bolt in alignment with each leg, whereby axial rotation of said bolt member causes peripheral portions of said bolt member to enter into the notches and thereby lock the legs within the base, and continued rotation causes the bolt notches to axially align with the legs for endwise movement of the legs relative to the base for unlocking the legs;

and locking means operable for rotating said bolt;

the opposite ends of said base bore each being of an elongated diameter relative to the central portion thereof;

a centrally bored bushing inserted and closely fitted within each of said bore opposite ends and receiving the adjacent end portion of said bolt for rotation of said bolt within the bushings, and each bushing having a notch aligned with and receiving its adjacent leg portion, and also aligned with a bolt notch arranged within the respective bushing;

and said lock means being mounted within one of said bushings for rotation of said bolt.

8. A lock as defined in claim 7, and said bushings each being completely contained within said base, with each bushing having its inner end, i.e., relative to its adjacent base end, retained for moving inwardly, that is, towards the opposite bushing, by an annular shoulder formed at the intersection of the central portion of the base bore and its enlarged end portion.

9. A lock comprising:

a base having a hole formed transversely thereof, and a bore extending transversely of the hole axis through said base and adjacent said hole;

a pin-like leg member normally extending into said base hole for locking therein;

an elongated bolt member rotatably fitted within said bore and overlapping said leg within the bar;

said leg member having a notch formed therein for partially receiving the adjacent overlapping portion of said bolt member and a notch formed in said bolt in alignment with the leg, whereby axial rotation of said bolt member causes peripheral portions of said bolt member to enter into the notch in the leg member and thereby lock the leg member within the base, and continued rotation causes the bolt notch to axially align with the leg member for endwise movement of the leg member relative to the base for unlocking removal therefrom;

and locking means operable for rotating said bolt member;

said base bore having an enlarged diameter portion;

a centrally bored bushing inserted and closely fitted whtin said bore enlarged diameter portion and receiving the adjacent portion of said bolt member for rotation of said bolt member within the bushing, and said bushing having a notch aligned with and receiving the adjacent leg portion and also aligned with the bolt notch which is arranged within the bushing;

and said lock means being mounted within said bushing for rotation of said bolt.

10. A lock as defined in claim 9, and said bushing being substantially completely contained within said base and having means retaining one end thereof from moving in the direction towards its opposite end and formed within the bore enlarged diameter portion.

* * * * *